US009122230B2

(12) United States Patent
Kamigaito et al.

(10) Patent No.: US 9,122,230 B2
(45) Date of Patent: Sep. 1, 2015

(54) GROUNDING STRUCTURE

(71) Applicant: FUJI XEROX CO., LTD., Tokyo (JP)

(72) Inventors: Naoya Kamigaito, Kanagawa (JP); Yasuhiro Kurokawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 20 days.

(21) Appl. No.: 14/182,712

(22) Filed: Feb. 18, 2014

(65) Prior Publication Data

US 2015/0016008 A1 Jan. 15, 2015

(30) Foreign Application Priority Data

Jul. 12, 2013 (JP) ..... 2013-146197

(51) Int. Cl.
*H05F 3/00* (2006.01)
*G03G 21/16* (2006.01)

(52) U.S. Cl.
CPC .. *G03G 21/1652* (2013.01); *G03G 2215/00721* (2013.01)

(58) Field of Classification Search
CPC ..... H05F 3/04
USPC ..... 361/214
See application file for complete search history.

(56) References Cited

U.S. PATENT DOCUMENTS 3,781,757 A * 12/1973 Barnes ..... 439/95
5,826,153 A * 10/1998 Hazama et al. ..... 399/353
7,686,626 B2 * 3/2010 Wu et al. ..... 439/95
8,359,607 B2 * 1/2013 Yamauchi et al. ..... 720/650

FOREIGN PATENT DOCUMENTS

JP A-09-309245 12/1997
JP A-2000-010457 1/2000

* cited by examiner

*Primary Examiner* — Stephen W Jackson
(74) *Attorney, Agent, or Firm* — Oliff PLC

(57) ABSTRACT

Provided is a grounding structure including a grounding member that is grounded, an electrical conduction member that includes a protection section which is placed to protect a protection object, and an elastic portion which is connected to the protection section and is elastically deformed, the electrical conduction member being conductible, and a holding section that is formed in the grounding member and that holds the elastic portion in the grounding member by using an elastic force of the elastic portion, wherein the holding section and the elastic portion contact with each other on both sides of a direction in which the elastic force of the elastic portion acts.

5 Claims, 7 Drawing Sheets

GROUNDING STRUCTURE

CROSS-REFERENCE TO RELATED APPLICATIONS

This application is based on and claims priority under 35 USC 119 from Japanese Patent Application No. 2013-146197 filed Jul. 12, 2013.

BACKGROUND

Technical Field

The present invention relates to a grounding structure.

SUMMARY

According to an aspect of the invention, there is provided a grounding structure including:

a grounding member that is grounded;

an electrical conduction member that includes a protection section which is placed to protect a protection object, and an elastic portion which is connected to the protection section and is elastically deformed, the electrical conduction member being conductible; and a holding section that is formed in the grounding member and that holds the elastic portion in the grounding member by using an elastic force of the elastic portion, wherein the holding section and the elastic portion contact with each other on both sides of a direction in which the elastic force of the elastic portion acts.

BRIEF DESCRIPTION OF THE DRAWINGS

Exemplary embodiments of the present invention will be described in detail based on the following figures, wherein:

FIG. 5A is a plan view seen from a Z direction, and FIG. 5B is a side view seen from a Y direction;

DETAILED DESCRIPTION

An example of an image forming apparatus according to an exemplary embodiment of the present invention will be described.

Overall Configuration

Configuration of Image Forming Apparatus

Figure 1:
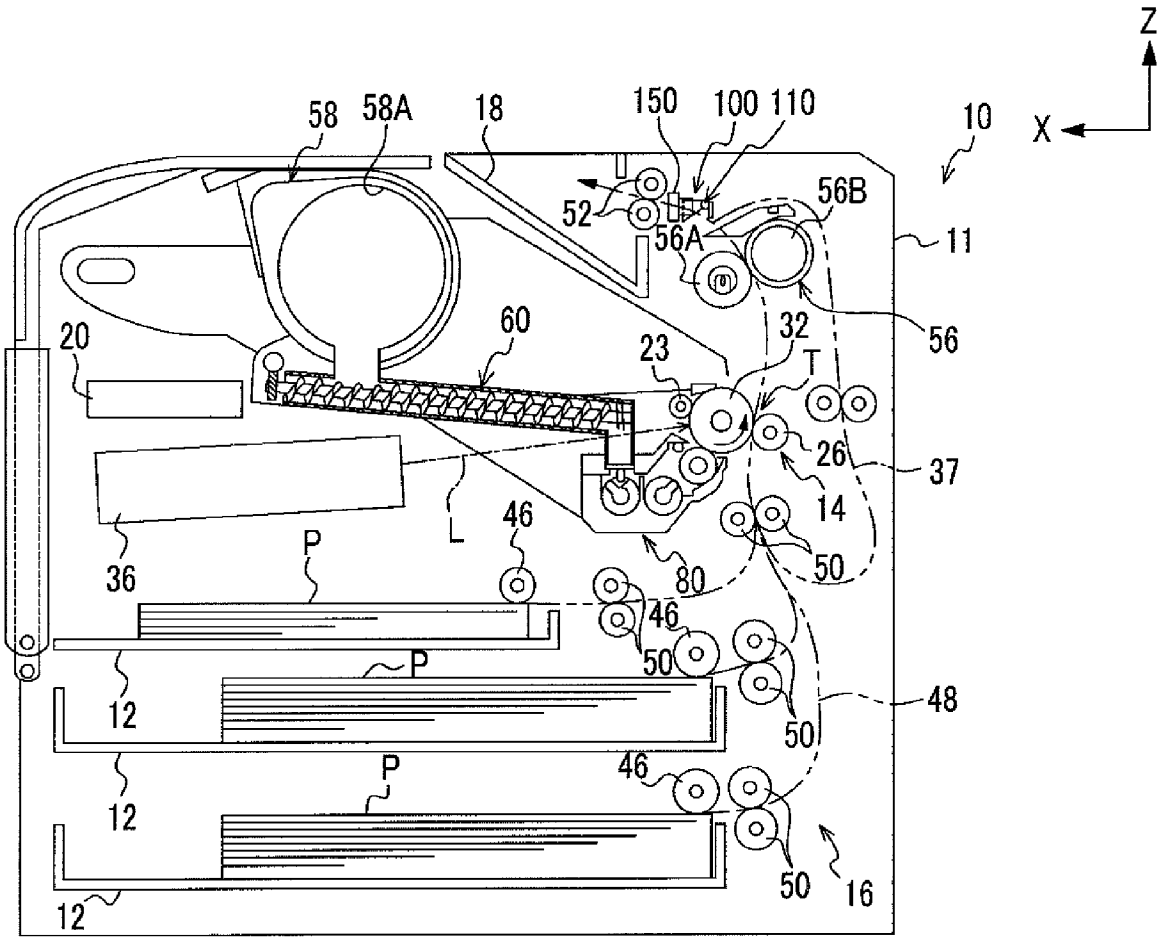
FIG. 1 is a configuration diagram showing a configuration of an image forming apparatus according to an exemplary embodiment of the present invention.

First, the configuration of an image forming apparatus 10 will be described. FIG. 1 is a configuration diagram showing the configuration of the image forming apparatus 10. A vertical direction upper side is a Z direction, an apparatus front side is an X direction, and a direction in which the Z direction and the X direction intersect with each other (apparatus width direction outer side) is a Y direction.

As shown in FIG. 1, the image forming apparatus 10 includes an apparatus body 11 in which each of components is accommodated. Plural accommodating sections 12 that accommodate a recording medium P such as a sheet, an image forming section 14 that forms an image on the recording medium P, a fixing device 56 that fixes the image that is formed on the recording medium P by the image forming section 14 onto the recording medium P, a transport unit 16 that transports the recording medium P from the accommodating section 12 to the image forming section 14, and a control unit 20 that controls an operation of each part of the image forming apparatus 10 are disposed in the apparatus body 11. Also, a discharge unit 18 that discharges the recording medium P on which the image is fixed by the fixing device 56 is disposed in an upper portion of the apparatus body 11.

The image forming section 14 has a photoconductor drum 32 that is an example of an image holding member which holds the image. The photoconductor drum 32 rotates in one direction (for example, counterclockwise direction in FIG. 1). A charging roller 23 that is an example of a charging device which charges the photoconductor drum 32, an exposure device 36 that forms an electrostatic latent image in the photoconductor drum 32 by exposing the photoconductor drum 32 which is charged by the charging roller 23, a developing device 80 that forms a black toner image by developing the electrostatic latent image which is formed in the photoconductor drum 32 by the exposure device 36, and a transfer roller 26 that transfers the black toner image which is formed in the photoconductor drum 32 by the developing device 80 to the recording medium P are disposed around the photoconductor drum 32 in order from a rotation direction upstream side of the photoconductor drum 32.

The exposure device 36 exposes exposure light L to the photoconductor drum 32 based on an image signal that is sent from the control unit 20, and forms the electrostatic latent image in the photoconductor drum 32. Examples of the image signal that is sent from the control unit 20 include an image signal acquired by the control unit 20 from an external device.

A toner cartridge 58 is disposed above the exposure device 36 as a toner accommodating container that accommodates toner. A toner accommodation chamber 58A in which the toner is accommodated is formed within the toner cartridge 58.

A toner transport device 60 that transports the toner from the toner accommodation chamber 58A of the toner cartridge 58 toward the developing device 80 is disposed between the toner cartridge 58 and the developing device 80.

The transfer roller 26 opposes the photoconductor drum 32, and transports the recording medium P upward with the photoconductor drum 32 by nipping the recording medium P. A position between the transfer roller 26 and the photoconductor drum 32 is defined as a transfer position T where the toner image formed in the photoconductor drum 32 is transferred onto the recording medium P.

The transport unit 16 has a feed roller 46 that feeds the recording medium P which is accommodated in each of the accommodating sections 12, a transport path 48 through which the recording medium P fed by the feed roller 46 is transported, and plural feed rolls 50 that are placed along the transport path 48 and transports the recording medium P fed by the feed roller 46 to the transfer position T.

The fixing device 56 has a heating roll 56A and a pressure roll 56B. The fixing device 56 fixes the toner image that is transferred to the recording medium P by the transfer roller 26 onto the recording medium P through heating by the heating roll 56A and pressurization by the pressure roll 56B. A discharge roller 52 that discharges the recording medium P on which the toner image is fixed toward the discharge unit 18 is disposed on a side above the fixing device 56 (transport direction downstream side).

Also, as will be described later, a detection mechanism 100 that detects the recording medium P which is discharged to the discharge unit 18 by the discharge roller 52 is disposed in the vicinity of the discharge roller 52 (refer to FIG. 2).

Also, a reversing transport path 37 that reverses the recording medium P on which the toner image is fixed on one side and sends the recording medium P back to the transfer position T is disposed on the opposite side (right side in FIG. 1) to the photoconductor drum 32 with respect to the transfer roller 26. When the image is formed on both sides of the recording medium P, the recording medium P on which the toner image is fixed on the one side is switched back by the discharge roller 52, is guided to the reversing transport path 37, and is sent back to the transfer position T.

Image Forming Operation

Next, an image forming operation of the image forming apparatus 10 in which the image is formed on the recording medium P will be described.

In the image forming apparatus 10, the recording medium P that is fed by the feed roller 46 from any one of the accommodating sections 12 is fed toward the transfer position T by the plural feed rolls 50.

In the image forming section 14, the photoconductor drum 32 is charged by the charging roller 23 and then is exposed by the exposure device 36, and the electrostatic latent image is formed in the photoconductor drum 32. The electrostatic latent image is developed by the developing device 80, and the black toner image is formed in the photoconductor drum 32. The black toner image is transferred onto the recording medium P by the transfer roller 26 at the transfer position T.

The recording medium P on which the toner image is transferred is transported toward the fixing device 56, and the toner image is fixed by the fixing device 56. In a case where the image is formed on only the one side of the recording medium P, the recording medium P is discharged toward the discharge unit 18 by the discharge roller 52 after the toner image is fixed.

In a case where the image is formed on both of the sides of the recording medium P, the recording medium P is switched back with the discharge roller 52, is reversed, and is fed toward the reversing transport path 37 after the image is formed on the one side. Further, the recording medium is fed back toward the transfer position T from the reversing transport path 37, the image is formed in a similar manner as described above on the opposite side where the image is not recorded, and the recording medium P is discharged toward the discharge unit 18 by the discharge roller 52.

The discharge of the recording medium P toward the discharge unit 18 is detected by the detection mechanism 100 that will be described later.

Detection Mechanism

Figure 5A:
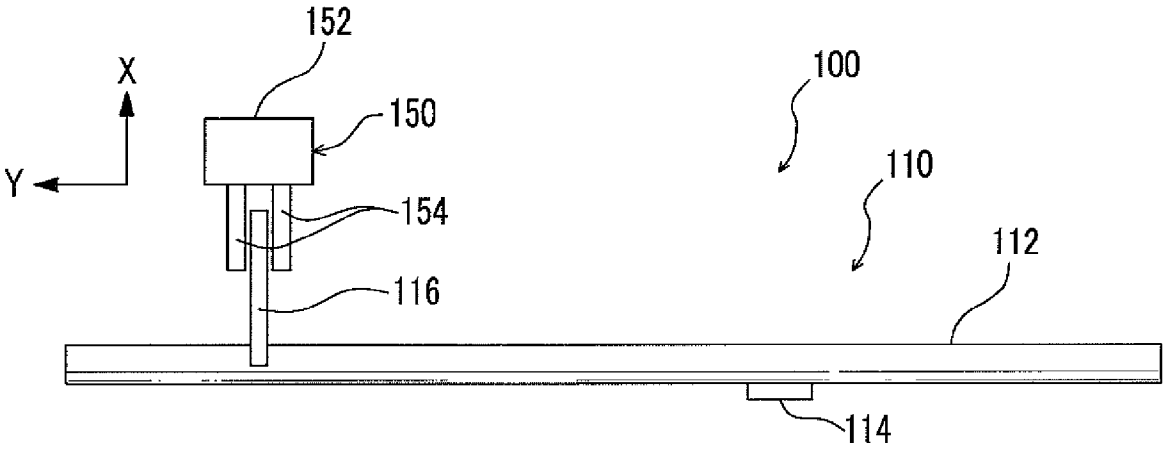
FIGS. 5A and 5B are schematic diagrams of a detection mechanism.
Figure 5B:
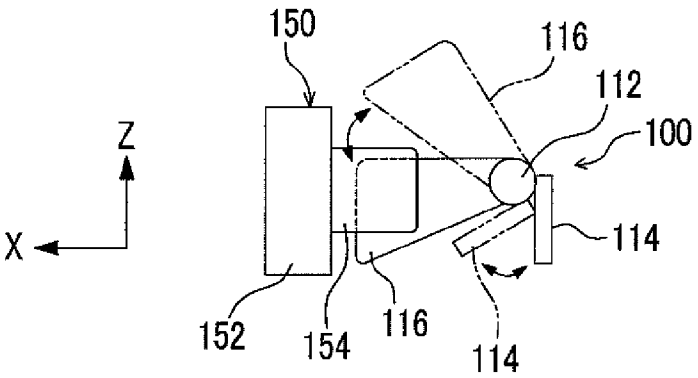

As shown in FIGS. 1, 5A, and 5B, the detection mechanism 100 is provided with a detection member 110 that has a rotating shaft 112 which is rotatably disposed in the Y direction, a claw portion 114 that is disposed in an axial direction central part of the rotating shaft 112, and a detection piece section 116 that is disposed in an end portion of the rotating shaft 112. As shown in FIG. 1, the detection member 110 is placed in the vicinity of a transport direction upstream side from the discharge roller 52.

As shown in FIG. 5B, a sensor 150 as a detector is disposed in the vicinity of an axial direction outside end portion of the detection member 110.

Figure 2:
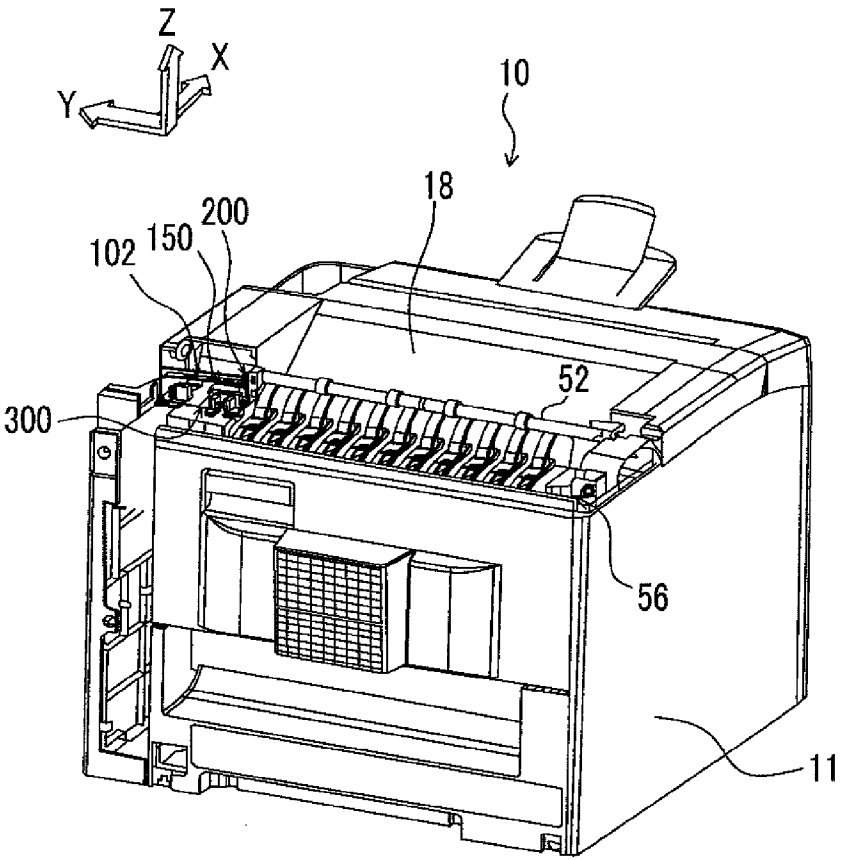
FIG. 2 is a perspective diagram showing placement positions of a sensor and a charge-removal member of the image forming apparatus according to the exemplary embodiment of the present invention.
Figure 3:
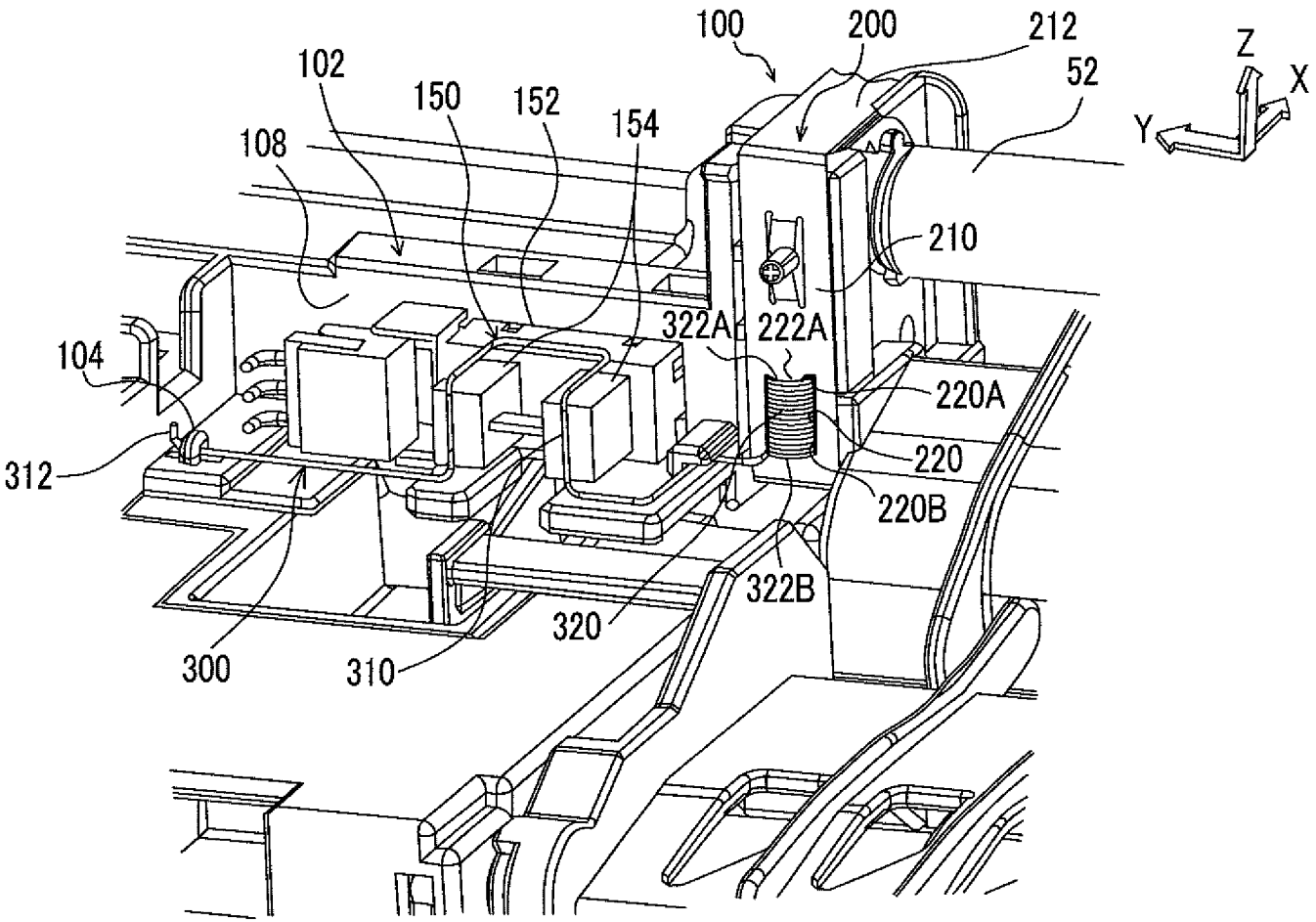
FIG. 3 is an enlarged perspective diagram in which main parts of FIG. 2 are enlarged.

As shown in FIG. 2, the sensor 150 is mounted on a resinous housing 102 at a Y direction outside part of the fixing device (refer also to FIG. 3).

As shown in FIGS. 3, 5A, and 5B, the sensor 150 is a transmission type photo sensor that has a body section 152 and a pair of detection units 154 which are disposed in the body section 152 with a gap from each other, a light-emitting element being disposed in one of the pair of detection units 154 and a light receiving element being disposed in the other. The sensor 150 is configured in such a manner that detection light is emitted from the light-emitting element of the one of the detection units 154 and the detection light is received by the light receiving element of the other of the detection units 154. The sensor 150 electrically converts the detection light that is received by the light receiving element, and feeds a signal to a control device which is not shown herein.

Normally (during non-discharge), the detection piece section 116 of the detection member 110 is placed between the pair of detection units 154 of the sensor 150 as shown in FIGS. 5A and 5B. As such, normally (during non-discharge), the detection piece section 116 is in a state of shielding the detection light.

As shown with an imaginary line (dashed line) in FIG. 5B, the recording medium (recording sheet) P hits the claw portion 114 of the detection member 110 and the rotating shaft 112 rotates when the discharge of the recording medium P is initiated. When the rotating shaft 112 rotates, the detection piece section 116 falls out from between the pair of detection units 154 and the detection light is received by the light receiving element so that it is detected that the recording medium P is being discharged. When the discharge of the recording medium P is completed, the detection piece section 116 returns to an original state so that the detection light is shielded and it is detected that the discharge of the recording medium P is completed.

In addition, normally (during non-discharge), the detection piece section 116 may be configured to fall out from between the pair of detection units 154 in a state where the detection light is received by the light receiving element (imaginary line (dashed line)) and, during the discharge of the recording medium P, the detection piece section 116 may be configured to be in a state of shielding the detection light (solid line).

As shown in FIGS. 3, 4A, 4B, and 4C, the detection mechanism 100 has a sheet metal 200 (FIG. 4A) as an example of a grounding member, and a charge-removal member (lightning rod) 300 (FIG. 4C) as an example of an electrically conductive member.

Figure 4A:
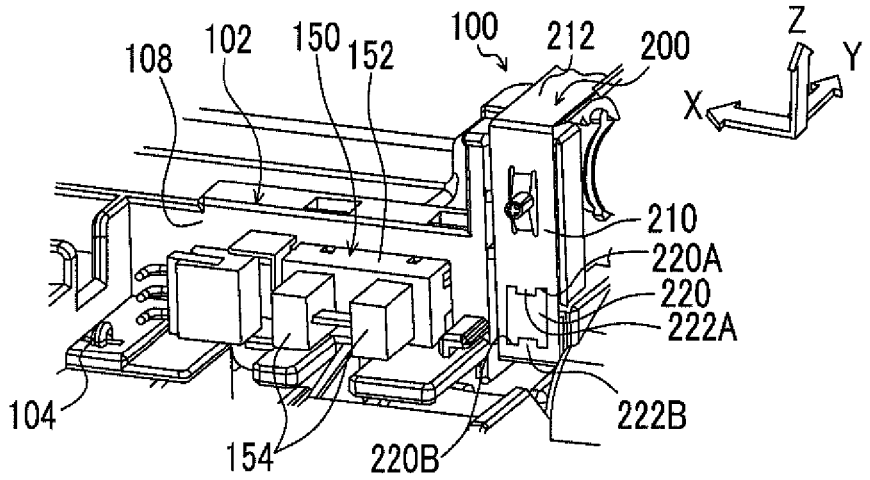
FIG. 4A is an enlarged perspective diagram of FIG. 2 showing a state where the charge-removal member is not mounted.

As shown in FIGS. 3 and 4A, the sheet metal (first metal member) 200 is band-shaped and is fixed to the resinous housing 102. Also, the sheet metal 200 is bent in an L shape when viewed from a side, and is electrically connected to a metallic apparatus housing, not shown herein, in which an upper surface portion 212 is electrically grounded. Accordingly, the sheet metal 200 is also grounded.

A mounting hole 220 is formed in a mounting surface (vertical surface) 210 of the sheet metal 200. The mounting hole 220 has a substantially rectangular shape, and convex portions 222A and 222B are formed in inner edge portions 220A and 220B opposing each other in a longitudinal direction.

Figure 4B:
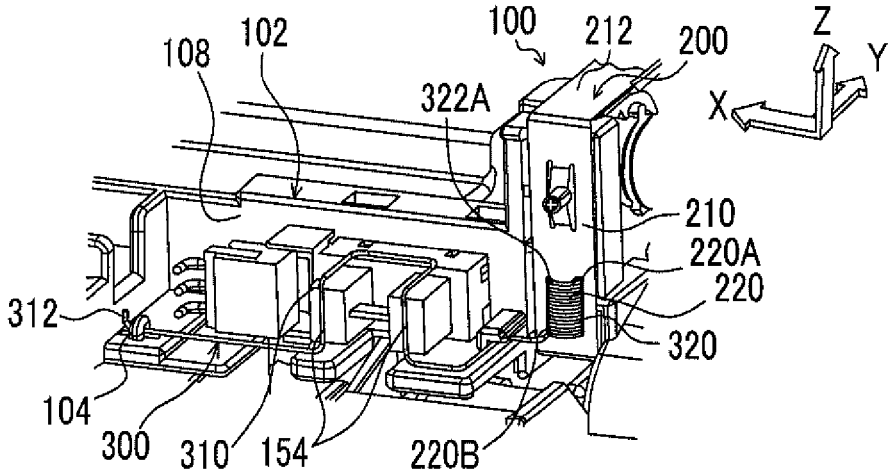
FIG. 4B is an enlarged perspective diagram showing a state where the charge-removal member is mounted.
Figure 4C:
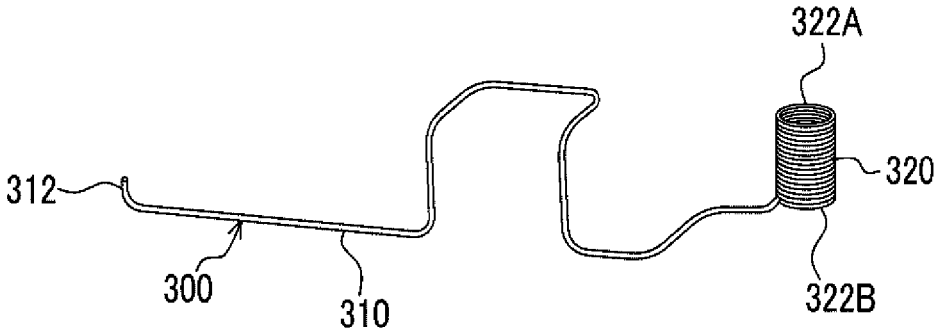
FIG. 4C is a perspective diagram showing the charge-removal member.

As shown in FIG. 4C, the charge-removal member (second metal member) 300 is configured to have a linear-shaped wire section (linear-shaped section) 310, and a coil-shaped spring section 320 that is formed in an end portion of the wire section 310. The charge-removal member 300 is formed from a wire of SUS and is electrically conductive. As shown in FIGS. 3 and 4B, the linear-shaped wire section 310 of the charge-removal member 300 is placed in close proximity along the vicinity of the sensor 150 that is a protection object, and is placed to protect the sensor 150. Specifically, the wire section 310 is around the pair of detection units 154 of the sensor 150 and the body section 152 therealong, and an end portion 312 is inserted into and fixed to a hole of a projecting portion 104 that is formed at a position of the resinous housing 102 which is separated from the sensor 150. The protection of the sensor 150 will be described later.

As shown in FIGS. 3 and 4B, the spring section 320 of the charge-removal member 300 is formed as a compression coil spring, and the spring section 320 is fitted (held) in a compressively deformed state to the mounting hole 220 of the mounting surface 210 of the sheet metal 200. In this manner, the spring section 320 of the charge-removal member 300 and the sheet metal 200 are electrically conductive to each other.

In this exemplary embodiment, specifications of the spring section 320 such as a spring constant and a spring length, a gap between the inner edge portions 220A and 220B of the mounting hole 220 and the like are set in such a manner that a pressing force with which an end portion 322A of the spring section 320 of the charge-removal member 300 is pressed against the inner edge portion 220A of the mounting hole 220 is at least 2N.

The convex portions 222A and 222B of the inner edge portions 220A and 220B of the mounting hole 220 are put into the spring section 320 as stoppers. Also, the end portion 312 of the wire section 310 of the charge-removal member 300 is in an electrically floating state.

Effect

Next, an effect of this exemplary embodiment will be described.

Effect of the Charge-Removal Member

First, the effect of the charge-removal member (lightning rod) 300 will be described.

The charge-removal member 300 is electrically conductive to the sheet metal 200, and the sheet metal 200 is grounded. Accordingly, in a case where static electricity is generated for some reason in the vicinity of the sensor 150, the static electricity is discharged (applied) to the wire section 310 of the charge-removal member 300, and flows to the sheet metal 200 where the end portions 322A and 322B of the spring section 320 are pressed to be conductive. Accordingly, a misoperation of the sensor 150 due to the discharge (application) of the static electricity to the sensor 150 is prevented.

COMPARATIVE EXAMPLE

Next, the comparative example will be described.

Figure 6:
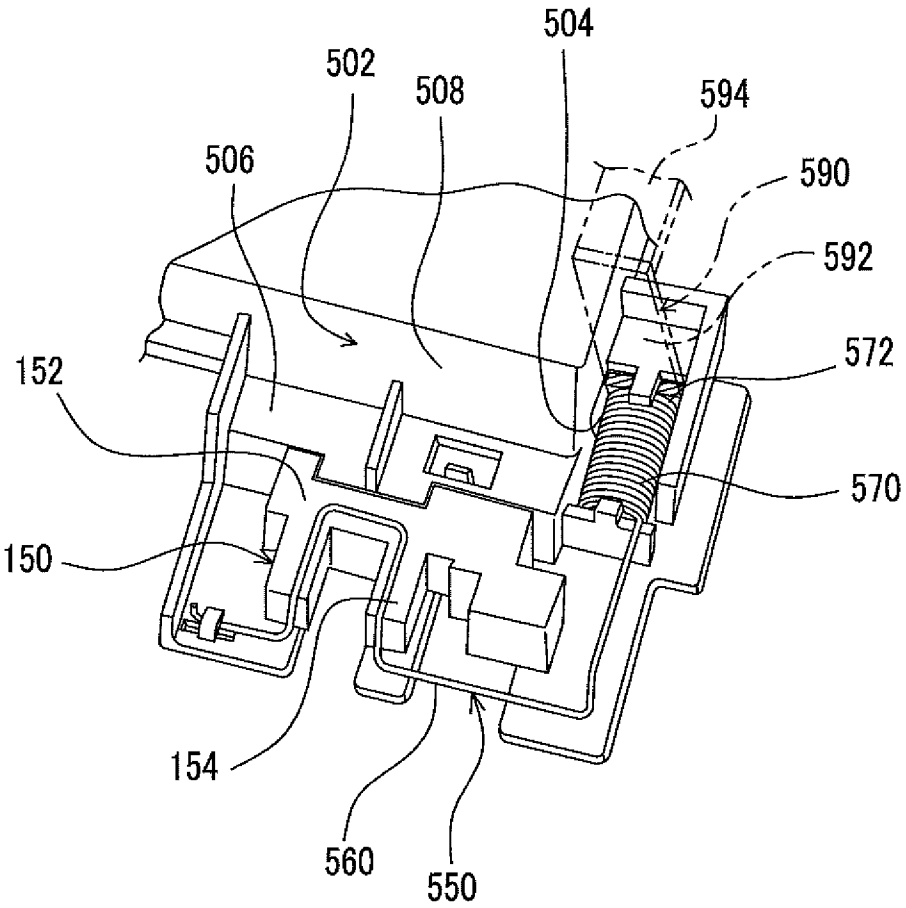
FIG. 6 is a perspective diagram showing main parts of a detection mechanism according to a comparative example.

A charge-removal member 550 of the comparative example that is shown in FIG. 6 is configured to have a linear-shaped wire section 560 and a spring section 570 which are placed in close proximity in the vicinity of the sensor 150. The spring section 570 is fitted to and held by a recessed portion 504 that is formed in a resinous housing 502. Also, a mounting surface (vertical surface) 592 of a grounded and band-shaped sheet metal 590 is fixed to an end face of the recessed portion 504.

An end portion 572 of the spring section 570 of the charge-removal member 550 is pressed against the mounting surface 592 of the sheet metal 590 so that the spring section 570 of the charge-removal member 550 and the sheet metal 590 are electrically conductive to each other. Also, an upper surface portion 594 of the sheet metal 590 is electrically connected to the electrically grounded metallic apparatus housing, which is not shown herein.

Effect

Next, the effect of this exemplary embodiment will be described in comparison to the comparative example.

In the comparative example that is shown in FIG. 6, a space (recessed portion 504) to hold the spring section 570 of the charge-removal member 550 is required to be ensured in the resinous housing 502 (Y direction outside part of the fixing device in the image forming apparatus). Also, for this reason, an extra space 506 is generated between a wall surface 508 of the resinous housing 502 and the sensor 150.

In contrast, in this exemplary embodiment, the spring section 320 of the charge-removal member 300 is fitted to and held by the mounting hole 220 formed in the grounded sheet metal 200 in a compressively deformed state as shown in FIGS. 3, 4A, 4B, and 4C. Accordingly, there is no need to ensure an additional space (recessed portion 504, refer to FIG. 6) to hold the spring section 320 in the resinous housing 102. Also, for this reason, a wall surface 108 and the sensor 150 are placed in close proximity and the extra space 506 (refer to FIG. 6) as in the comparative example is not generated. Accordingly, (a part in the vicinity of the sensor 150 of) the Y direction outside part of the fixing device 56 of the image forming apparatus 10 according to this exemplary embodiment shown in FIGS. 3, 4A, 4B, and 4C is reduced in space compared to the comparative example of FIG. 6.

Also, a holding section (recessed portion 504, refer to FIG. 6) to hold the spring section 320 does not have to be formed in the resinous housing 102, and thus costs are saved and the degree of design flexibility is improved for the resinous housing 102.

Also, in the comparative example that is shown in FIG. 6, a manufacturing tolerance (irregularity) of the recessed portion 504 of the resinous housing 502 causes an increased positional irregularity between the spring section 570 and the mounting surface 592 of the sheet metal 590 and an increased irregularity, that is, contact pressure, of the pressing force with which the end portion 572 of the spring section 570 of the charge-removal member 550 is pressed against the mounting surface 592 of the sheet metal 590.

Accordingly, in a case where a high contact pressure is not ensured (in a case where the pressing force of at least 2N is not ensured) due to the manufacturing tolerance (irregularity), there is a concern that conduction resistance between the spring section 570 of the charge-removal member 550 and the sheet metal 590 increases and the static electricity is discharged (applied) to the sensor 150 without being discharged (applied) to the wire section 560 of the charge-removal member 550.

In contrast, in this exemplary embodiment, the spring section 320 of the charge-removal member 300 is fitted to and held by the mounting hole 220 of the mounting surface 210 of the sheet metal 200 in a compressively deformed state as shown in FIGS. 3, 4A, 4B, and 4C, and thus is not affected by the manufacturing tolerance (irregularity) of the resinous housing 102. Further, both of the end portions of the spring section 320 contact with the sheet metal 200. Herein, both of the end portions are both of the end portions in a direction in which an elastic force of the spring section 320 acts, that is, a direction in which the spring section 320 is deformed.

Accordingly, an irregularity of the contact pressure with which the end portions 322A and 322B of the spring section 320 of the charge-removal member 300 are pressed against the inner edge portions 220A and 220B of the mounting hole 220 is suppressed, and thus an irregularity of the conduction resistance between the spring section 320 of the charge-removal member 300 and the sheet metal 200 is suppressed.

Further, in this exemplary embodiment, the specifications of the spring section 320 such as the spring constant, the gap between the inner edge portions 220A and 220B of the mounting hole 220 and the like are set in such a manner that the pressing force with which the end portion 322A of the spring section 320 of the charge-removal member 300 is pressed against the inner edge portion 220A of the mounting hole 220 is at least 2N so that a state where the conduction resistance is low is ensured.

Accordingly, the static electricity is prevented from being discharged (applied) to the sensor 150 without being discharged (applied) to the wire section 310 of the charge-removal member 300 by an increased conduction resistance between the spring section 320 of the charge-removal member 300 and the sheet metal 200.

MODIFICATION EXAMPLE

Next, the modification example of this exemplary embodiment will be described.

In this exemplary embodiment, the spring section 320 of the charge-removal member 300 is mounted on the mounting hole 220 that is formed on the mounting surface 210 of the sheet metal 200, but the present invention is not limited thereto.

Figure 7:
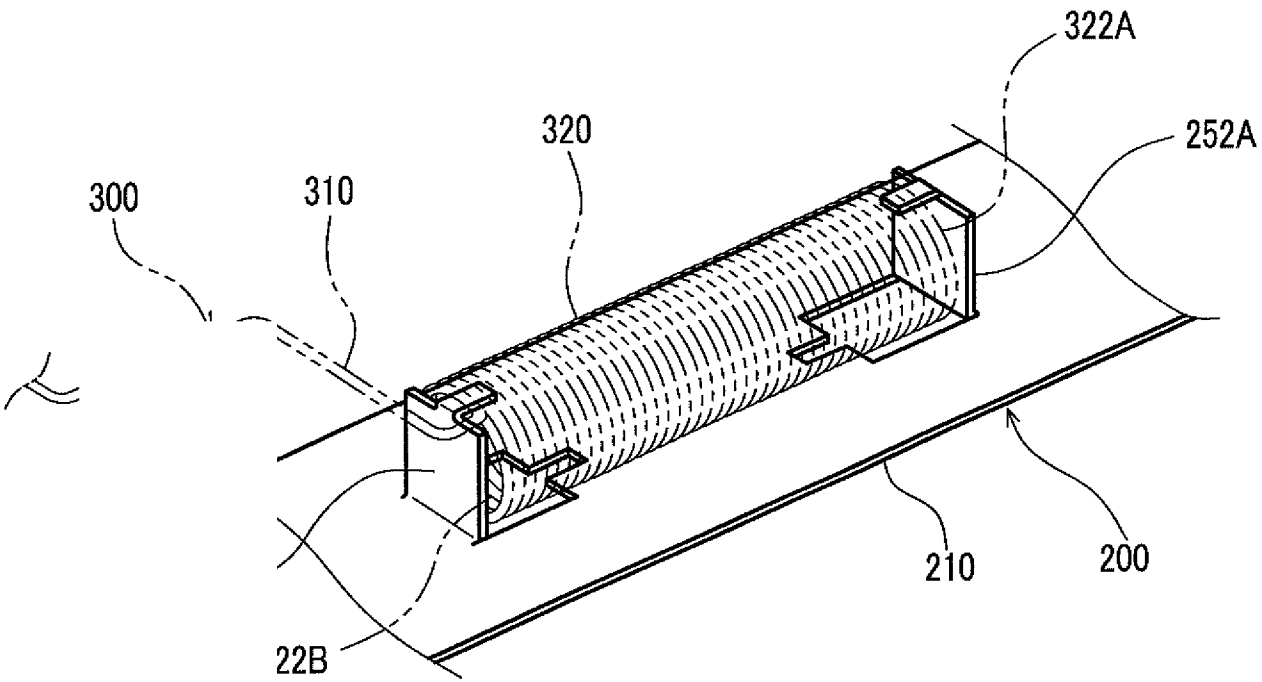
FIG. 7 is a perspective diagram showing main parts of a detection mechanism according to a modification example.

For example, as shown in FIG. 7, the spring section 320 of the charge-removal member 300 maybe held in a compressively deformed state between a cut-and-raised piece 252A and a cut-and-raised piece 252B that are formed by being cut and raised on the mounting surface 210 of the sheet metal 200 and oppose each other.

Others

The present invention is not limited to the above-described exemplary embodiment.

Various configurations are possible as the configuration of the image forming apparatus without being limited to the configuration of the above-described exemplary embodiment. Also, in the above-described exemplary embodiment, the image is formed by an electrophotographic system, but the present invention is not limited thereto. The present invention may be applied to image forming apparatuses that form an image by other known methods such as an inkjet method and a thermal transfer method.

Also, in the above-described exemplary embodiment, the present invention is applied to the (sensor of) detection mechanism that detects the discharge of the recording medium, but the present invention is not limited thereto. The present invention may be widely applied to a structure in which the charge-removal member is disposed so as to prevent the discharge (application) of the static electricity toward the sensor. Also, the protection object is not limited to the sensor, but may be used with respect to a terminal such as a memory.

Further, it is a matter of course that the present invention can be embodied by various aspects without departing from the scope of the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A grounding structure comprising:

a grounding member that is grounded;

an electrical conduction member that includes a protection section which is placed to protect a protection object, and an elastic portion which is connected to the protection section and is elastically deformed, the electrical conduction member being conductible; and a holding section that is formed in the grounding member and that holds the elastic portion in the grounding member by using an elastic force of the elastic portion, wherein the holding section and the elastic portion contact with each other on both sides of a direction in which the elastic force of the elastic portion acts.

2. The grounding structure according to claim 1, wherein the holding section is a hole section that is formed in the grounding member, and the elastic portion is fitted into the hole section.

3. The grounding structure according to claim 1, wherein the holding section includes convex portions formed in inner edge portions opposing each other in the ground member.

4. The grounding structure according to claim 1, wherein the holding section includes cut-and-raised pieces formed in inner edge portions opposing each other in the ground member.

5. The grounding structure according to claim 1, wherein a pressing force pressed against the holding section is at least 2N.

* * * * *